US008425728B2

(12) United States Patent
Zhou et al.

(10) Patent No.: US 8,425,728 B2
(45) Date of Patent: Apr. 23, 2013

(54) PRINT MEDIA FOR HIGH SPEED, DIGITAL INKJET PRINTING

(75) Inventors: Xiaoqi Zhou, San Diego, CA (US); Xulong Fu, San Diego, CA (US); Dave Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 91 days.

(21) Appl. No.: 13/259,599

(22) PCT Filed: Jul. 17, 2009

(86) PCT No.: PCT/US2009/051067

§ 371 (c)(1), (2), (4) Date: Sep. 23, 2011

(87) PCT Pub. No.: WO2011/008218

PCT Pub. Date: Jan. 20, 2011

(65) Prior Publication Data

US 2012/0012264 A1 Jan. 19, 2012

(51) Int. Cl.

| | |
|---|---|
| ***D21H 19/38*** | (2006.01) |
| ***D21H 19/40*** | (2006.01) |
| ***D21H 19/50*** | (2006.01) |
| ***D21H 19/52*** | (2006.01) |
| ***D21H 19/54*** | (2006.01) |
| ***D21H 19/56*** | (2006.01) |
| ***D21H 19/64*** | (2006.01) |

(52) U.S. Cl.

USPC ..... 162/168.1; 162/135; 162/136; 162/158; 162/174; 162/175; 162/177; 162/181.1; 162/181.2; 162/181.8; 106/157.2; 106/157.71; 106/159.1; 106/172.1; 106/204.3; 106/217.01; 428/32.18; 428/32.28; 428/32.3; 428/32.34; 428/32.38

(58) Field of Classification Search ..... 162/135, 162/136, 158, 168.1, 174, 175, 177, 181.1–181.2, 162/181.8; 106/157.2, 157.71, 159.1, 172.1, 106/204.3, 217.01; 428/32.18, 32.28, 32.3, 428/32.34, 32.38

See application file for complete search history.

(56) References Cited

U.S. PATENT DOCUMENTS

| | | | | |
|---|---|---|---|---|
| 5,270,103 | A * | 12/1993 | Oliver et al. | 428/219 |
| 5,714,235 | A * | 2/1998 | Takeuchi et al. | 428/32.37 |
| 6,093,447 | A * | 7/2000 | Johnson et al. | 427/146 |
| 6,150,289 | A * | 11/2000 | Chen et al. | 501/148 |
| 6,350,507 | B1 * | 2/2002 | Iwamoto et al. | 428/32.33 |
| 6,689,430 | B2 * | 2/2004 | Sadasivan et al. | 428/32.34 |
| 7,682,438 | B2 * | 3/2010 | Song et al. | 106/214.1 |
| 7,976,678 | B2 * | 7/2011 | Dougherty et al. | 162/135 |
| 8,092,874 | B2 * | 1/2012 | Wexler et al. | 428/32.3 |
| 2004/0247804 | A1 * | 12/2004 | Kim et al. | 428/32.36 |
| 2005/0003113 | A1 * | 1/2005 | Chen et al. | 428/32.18 |
| 2009/0165977 | A1 * | 7/2009 | Huang et al. | 162/168.1 |
| 2010/0080916 | A1 * | 4/2010 | Song et al. | 427/288 |
| 2010/0086709 | A1 * | 4/2010 | Huang et al. | 428/32.18 |

* cited by examiner

*Primary Examiner* — Mark Halpern
*Assistant Examiner* — Dennis Cordray

(57) ABSTRACT

Disclosed is a print medium for high speed, digital inkjet printing, which has high brightness and is resistant to yellowing. The print medium includes a base paper formed from a fiber furnish containing at least 30% by weight of mechanical pulp, and a coating layer formed on at least one surface of the base paper. The coating layer contains a metallic salt, a combination of two different binders at a predetermined ratio, and at least one inorganic pigment. A method of making the print medium is also disclosed.

15 Claims, No Drawings

PRINT MEDIA FOR HIGH SPEED, DIGITAL INKJET PRINTING

This application is a 371 of PCT/US09/51067, filed 17 Jul. 2009.

BACKGROUND

High speed, digital inkjet web press printing is a commercial printing technology developed to print on a continuous paper web at rates of hundreds of feet per minute. Printing is done on continuous-web printing presses. The paper web, which is a continuous roll of paper, is conveyed along a paper path that includes stationary inkjet printheads for ejecting a series of ink droplets onto the web. The present disclosure relates to an improved print medium that is particularly suitable for such high speed, web press printing.

DETAILED DESCRIPTION

The majority of inkjet inks are water-based inks containing colorants, which are either pigments or dyes. The capability and speed of a paper web to absorb the solvent of the inks is especially critical to media used in digital inkjet web press printing. When conventional coated print media, such as offset paper, were used in high speed, digital web press, challenges have been encountered. Poor image quality such as ink bleed coupled with poor black and color optical density are among the main problems encountered. Another major problem with using conventional print media when in high speed, inkjet web press relates to slow ink absorption rate of the media, which accordingly requires extended ink drying time. Such extended drying time limits the speed at which printing can be performed. In order to address these existing issues, the present disclosure provides an improved print medium, which is designed to impart fast ink absorption while readily fixing the colorants in the ink to the printed paper surface to achieve an excellent image quality. The improved print medium includes a base paper made from a fiber furnish containing mechanical pulp and a coating layer on at least one of two opposing surfaces of the base paper.

The cellulose fiber pulps used in the manufacturing of print media, i.e., papers, can be classified as chemical pulp or mechanical pulp (i.e., wood-containing pulps). Chemical pulp refers to pulp that has been subjected to a chemical process where the heat and chemicals break down the lignin (the substance that binds the cellulose fibers together) without seriously degrading the cellulose fibers. This process removes the lignin from the pulp to thereby yield cellulose fibers with very small amount of lignin. The mechanical pulp can be further divided into groundwood pulp and the thermo-mechanical pulp (TMP). TMP pulp may be chemically enhanced in some cases, and in such cases, it is referred to as chemo-thermo-mechanical pulp (CTMP).

In groundwood pulp production, the logs of wood are pressed on grinding stones by means of mechanical presses. The wood is split into fibers with the help of water. As a result of which, the wood fibers are released but still contain a large variety of contaminants. Groundwood pulp has a high yield of approximately 95% and a high level of opacity but its strength is relatively low, due to its lignin content. In the TMP process, the wood is processed into chips, which are mostly of a uniform size. These are then transported to an impregnating station, where the chips are saturated with chemicals and heated. After this stage they are passed through refiner stations and then screened and bleached. The finished stock still contains some lignin which comes from the cell walls and makes the paper yellow. In the case of CTMP pulp, the wood chips are pretreated with sodium carbonate, sodium hydroxide, sodium sulfite and other chemicals prior to refining. The conditions of the chemical treatment are much less vigorous (lower temperature, shorter time, less extreme pH) than in a chemical pulping process, since the goal is to make the fibers easier to refine, not to remove lignin as in a fully chemical process.

The papers made from chemical pulps generally show good physical properties such as good paper strength, high brightness and whiteness, and good light durability (i.e., resistant to paper yellowing) as compared to the papers made from mechanical pulps. Chemical pulp is typically used for making high quality papers. However, the chemical pulping process is a low yield procedure and requires costly chemicals in chemical processing to remove the wood lignin. This makes the papers based on chemical pulp more expensive than papers based on mechanical pulp. To obtain a low cost, high brightness paper, the prior art solutions include applying a high brightness white pigment coating on the wood-containing paper to overcome the yellowing effect resulted from wood lignin. These wood-containing papers have been widely used as the receiving media in conventional commercial printings, such as offset printing.

As discussed above, the base paper according to the present disclosure is made from a fiber furnish containing mechanical pulp, also known as wood-containing pulp. Suitable mechanical pulp includes ground-wood pulp, thermo-mechanical pulp (TMP), chemo-thermo-mechanical pulp (CTMP). In order to meet the quality and cost objectives of the present disclosure, the base paper preferably meets at least one of the following conditions, and even more preferably, all of the following conditions:

(a) The total amount of mechanical pulp in the base paper is not less than 30% by weight, and in preferred embodiments, not less than 80% by weight.

(b) To modify the paper properties such as strength, chemical pulps made from chemical processing may be included in the base paper.

(c) To create good surface for high quality printing, the roughness of the base paper is limited to not great than 150±10 ml as measured by a Parker Print-Surf Roughness Tester Model M590 and referenced to TAPPI method T555 "Roughness of Paper and paperboard (Print-surf method)".

(d) To ensure fast ink absorption under high speed, inkjet web printing condition (400-800 ft/min), the average pore size of the cellulosic base paper is desirably limited to certain range. Paper is composed of a randomly felted layer of fiber, it follows that the structure has a varying degree of porosity created by the voids with various size and distribution. The average pore size of the cellulosic base paper is within the range of 0.01 μm to 5.0 μm as measured by a Mercury size extrusion tester supplied by Micrometritics Inc. Mercury porosimetry, which characterizes a material's porosity by applying various levels of pressure to a sample immersed in mercury. The pressure required to intrude mercury into the sample's pores is inversely proportional to the size of the pores.

(e) The base paper may be internally sized by adding one or more internal sizing agents that are known in the prior art, or without internal sizing where the fiber binding strength is provided by the lignin existing in the pulp. Whether the internal sizing is used or not, the HST value, as measured by Hercules Sizing Tester, of the base paper is preferably in the range of 5 to 250 seconds.

The costing layer is formed by applying an aqueous coating composition to at least one surface of the base paper followed by a drying process. The coating composition includes, as basic components, an ink fixative, a combination of two different binders (primary and secondary) at a predetermined ratio, and at least one white inorganic pigment.

The ink fixative functions to chemically, physically, and/or electrostatically bind the colorant pigments in the ink at or near the outer surface of the paper being printed to obtain a high-degree of water-fastness, smear-fastness, and image stability. Another function of the ink fixative is to reduce the ink dry time. Suitable fixatives include metallic salts. The metallic salts may be selected from water-soluble, mono- or multivalent metallic salts, which have cation selected from Group I metals, Group II metals, Group III metals, or transition metals, e.g. sodium, calcium, copper, nickel, magnesium, zinc, barium, iron, aluminum and chromium ions. The metallic salts may also have anion selected from chloride, iodide, bromide, nitrate, sulfate, sulfite, phosphate, chlorate, acetate ions, or various combinations thereof.

The amount of the ink fixative present is an important contributor to the final print image quality. Inadequate amount of the ink fixative can only interact partially with the ink colorant, e.g., pigments, and results in lower optical density. On the other hand, excessive ink fixative amount may not only cause the paper to be overly sensitive to the moisture in environment, but also adversely interact with the binders in the coating composition, and thereby negatively affect the rheology of the coating composition. The amount of the ink fixative is dependent, upon the pick-up capacity of the base paper. The relative ratio of the ink fixative to the secondary binder, by weight, is preferably from 15:2 to 75:2, for a base paper that has a strong pick-up capability in the range of several seconds, up to 10-120 seconds, as measure by its HST value.

The binder component in the coating composition is a combination/blend of a primary binder and a secondary binder. The primary binder is a water-soluble material which can bind the inorganic pigment particles to form a coating layer, but is inert to the metallic salt. The term "inert" as used herein means that the binder will not interact with the fixative so as to cause the binder to be precipitated, gelled, or form any kind of solid particle, which would adversely reduce the binding capability of the binder and coatingability of the composition. The primary binder is selected from natural macromolecules, which include casein, soy protein, polysaccharides, cellulose ethers, alginates; virgin and modified starches, or selected from synthetic compounds inert to the metallic salt, which include polyvinyl alcohol and polyvinyl pyrrolidone. The secondary binder is selected from materials with higher binding power than the primary binder. The index of the binding power of the secondary binder to the primary binder is 1.2 to 5. The index of binding power is defined as the relative amounts by weight needed to obtain the same coating strength. Suitable secondary binders include polymeric latexes, which include but not limited to acrylic latex, styrene-butadiene latex, polyvinyl acetate latex, and copolymer latex thereof. The amount of the secondary binder is critical to the coating performance. While polymeric latex can provide extra binding power to the coating composition, it can also react with the metal salt and destabilize the coating composition. It has been discovered that certain ratio of primary binder to second binder produces-optimal results. The primary binder to secondary binder ratio, in dry weight, is preferably from 6:1 to 200:1.

The electrokinetic property of the binder blend, when they are mixed with the inorganic pigment in the aqueous coating solution, is critical to the performance-related properties of the binders such as binding power and composition stability. The electrokinetic property is measured in terms of Zeta potential. The proportions of the primary and secondary binders in the binder combination, as described above, are adjusted so that a specific Zeta potential range is satisfied. The term "Zeta potential" as used herein refers to the potential difference between the dispersion medium and the stationary layer of fluid attached to the dispersed particle. Zeta potential relates to surface charge and electrophoretic mobility, and is a well known property measurement. It has been discovered that the optimal Zeta potential is in the range of ±5 mV, more preferably in the range of −2 mV to 1 mV. Such Zeta potential range has been found to produce an aqueous coating solution with desirable stability, good binding capability and suitable rheology. If the Zeta potential is too low, the binder blend will adversely react with the metallic salt ink fixatives and produce gel. On the other hand, a binder blend with too high Zeta potential will cause precipitation of the inorganic pigment slurry.

The glass transition temperature ($T_g$) of the secondary binder is also an important factor to determine the MFFT (minimum film-forming temperature) of the secondary binder, which in turn controls the binding powder. The $T_g$ of the secondary binder is preferably not greater than 50° C., more preferably not greater than 30° C., and even more preferably in the range of −20° C. to 20° C. A secondary binder with too low $T_g$ will cause sheet blocking, but on the other hand, the binding power will suffer if $T_g$ is too high.

As discussed above, the coating composition includes at least one white inorganic pigment. The term "white inorganic pigment" refers to the selection of pigments with high brightness and/or whiteness. Suitable white inorganic pigments include calcium carbonates, such as mechanically ground calcium carbonate (GCC), or chemically produced, precipitated calcium carbonate (PCC). Due to the fact that the base paper of present disclosure is mainly selected from the papers which are made from mechanical wood-containing pulps, it has a tendency to impart a "yellowing effect" when it is exposed to the light. To reduce paper yellowing, it is desirable to have a coating composition, which provides good coverage for the base paper and is stable when exposed to light. To that end, a secondary pigment may be added. The secondary inorganic pigment preferably has a platelets morphology (or plate-like structure), which is good for covering the fibers at the surface of the base paper so as to smooth out the paper surface, and consequently, the surface smoothness of the paper is increased. The presence of the secondary pigment also reduces the yellowing effect of the mechanical pulp fibers over time, thereby increasing brightness and whiteness of the paper. In addition, the secondary inorganic pigment further acts to increase the opacity of the paper. Increasing the opacity reduces the likelihood of a printed image formed on one side of the paper from being visible on the opposite side of the paper. Suitable secondary inorganic pigments can be selected from, for example but not limited to, compounds with aluminum silicate structure, such as kaolin clay. In preferred embodiments, the weight ratio of the secondary pigment to the primary pigment is not greater than 30 parts based on 100 parts of inorganic pigments in total. Aluminum silicate to be used has a median ESD (equivalent spherical diameter) of about 0.9 μm to about 1:6 μm as determined, by a Microtrac-UPA150 laser light scattering device. In preferred embodiments, not more than 5% by weight of aluminum silicate particles has an ESD greater than 4.55 μm, and preferably not more than 10% by weight of aluminum silicate particles have an ESD smaller than 0.3 μm. The higher percentage of small ESD particles tend to reduce covering effect.

Optionally, other coating additives such as pH control agent, water retention agent, thickening agent, and various surfactants may be added into the coating composition of the present disclosure.

For print media to be used in high speed, inkjet web printing, the capability to absorb of the aqueous liquid in the inkjet inks is very critical to achieving a satisfactory image quality. The absorption capability is directly related to the porosity of the base paper and the coating structure, which is related to the coating composition and the coating method. Paper porosity is the measurement of the total connecting air voids, both vertical and horizontal, that exist in a printing paper. Porosity of the paper is an indication of absorptivity or the ability of the paper sheet to accept ink. In practice, the paper porosity can be represented by measuring the air resistance of the papers using the method defined in TAPPI "Air Permeance of Paper (Sheffield Method)", Test Method T 547 om-07. This method is used to measure the porosity by forcing air through paper, and measuring the rate of the air flow. The results are reported as Sheffield units.

Conventional pigmented coatings can vary widely in porosity depending on the pigment types, particle size and distribution, binder type and amount, coating conditions and post-coating processing such as calendaring. In the present disclosure, the final paper porosity is specifically acquired by adjusting the coating composition and the coating process. A coated paper with lower volume of voids indicates a poor porosity value which may cause extended dry time and result in smearing and ink bleeding during printing. An excessively high void value, however, presents an overly porous structure, which may absorb the majority of the ink colorant into the base paper, thereby generating low optical density (fading) images. The porosity of the final, finished (i.e., dried and calendared), coated paper of the present disclosure, as represented by air permeance, is preferably in the range of from 15 to 40 Sheffield units based on Parker Print-Surf tester.

A method of making the coated paper according to the present disclosure includes:

(a) mixing water and inorganic pigment(s) in a mixing tank;
(b) pre-mixing primary and secondary binder in a separate mixing tank and adjusting the ratio of the binders to ensure that the Zeta potential of the blend is in the range of +/−5 mV.
(c) adding the binder blend into the mixing tank and mixing the components therein to form a dispersion;
(d) adding metallic salt (pre-dissolved in water if the starting material is in the form of dry solids) and mixing the components in the tank to form a coating solution;
(e) optionally, adding additional coating additives to the coating solution;
(f) applying the coating solution onto at least one side of a base paper made mainly from mechanical pulp to form a coating layer thereon;
(g) drying the coated base paper; and
(h) optionally, post-finishing, e.g. calendaring.

The inorganic pigment(s), binder blend, and metallic salt are as described above with reference to the coating composition. The inorganic pigment particles may be directly charged into a mixing tank or may be pre-dispersed to form a filter-cake slurry. The coat weight of the coating layer ranges from 1-20 gsm per side, and preferably from 3 to 15 gsm per side. The base paper may take the form of a paper web suitable for web press printing. In one embodiment, the fiber furnish used for making the base paper contains 80% by weight or. more of mechanical pulp (ground-wood pulp, or thermo-mechanical pulp (TMP), or chemo-thermo-mechanical pulp (CTMP)). The fiber furnish may also contain 10%-20% by weight of chemical pulp and 4%-15% by weight of inorganic pigments/fillers such as calcium carbonate, clay or talc. Special pigments such as $TiO_2$, in amount of not greater than 3% by weight, may also be added as additional minerals to give extra opacity and brightness to the paper. The basis weight of base paper ranges from 30-170 gsm. The improved coated paper according to the present disclosure can be made into an ultra-light weight paper with basis weight ranging from 35 to 48 gsm. Even though this coated paper is ultra-light weight, a good printed image with negligible ink strikethrough can still be produced thereon due the unique combination of components in the coating composition.

The coating solution is applied onto the surface of the base paper using a conventional coating technique, such as surface sizing, to form a coating layer on the base paper. The surface sizing process includes using a size press such as a puddle-size press, a film-size press, or the like. The puddle-size press may be configured to have horizontal, vertical, or inclined rollers. The film-size press may include a metering system, such as gate-roll metering, blade metering, Meyer rod metering, or slot metering. In some embodiments, a film-size press with short-dwell blade metering may be used as the applicator for applying the coating solution. For the media having thicker coating, a off-line coater is used. Some non-limitative examples of suitable deposition techniques/manufacturing processes include roll-coating, conventional slot-die processing, blade coating, bent blade coating, rod coating, shear roll coating, slot-die cascade coating, pond coating, curtain coating and/or other comparable methods including those that use circulating and non-circulating coating techniques. In certain instances, spray-coating, immersion-coating, and/or cast-coating techniques may be used.

The following Examples will serve to illustrate representative embodiments and should not be construed as limiting of the disclosure in any way. All parts referred to herein are by weight unless otherwise indicated.

EXAMPLES

Example 1

Binder mixtures (B1-B9) with different binder ratios and pH around 6.0 were prepared, and their Zeta potential was measured by Zeta Sizer (Nano Series), Model ZEN3600, supplied by Malvern Instruments. After a calcium chloride solution with weight ratio to binder of 1:2 was mixed into the binder mixtures, the stability of the mixtures was observed. The primary binder is Panford 280, a commercially available ethylated modified corn starch from Panford Inc. The secondary binder is Dow XU 31264.5, a commercially available SBR (styrene-butadiene rubber) latex emulsion from Dow Co. For comparison, the same measurement and observation were also made for Panford 280 and XU 31264.5, as a single binder. The Zeta potential measurements and stability observation are shown in TABLE 1.

TABLE 1

| Sample ID | Ratio of primary binder to secondary binder | Zeta potential (mV) | pH | Stability after adding metallic salt |
|---|---|---|---|---|
| Panford 280 | Single binder | −0.33 | 6.50 | Stable |
| B1 | 0.43 | −26.90 | 6.31 | Unstable |
| B2 | 1 | −10.60 | 6.36 | Unstable |
| B3 | 2.33 | −3.41 | 6.42 | Slightly Unstable |
| B4 | 5.68 | −0.83 | 6.51 | Slightly unstable |

TABLE 1-continued

| Sample ID | Ratio of primary binder to secondary binder | Zeta potential (mV) | pH | Stability after adding metallic salt |
|---|---|---|---|---|
| B5 | 12.35 | −0.511 | 6.51 | Slightly unstable-→ less stable |
| B6 | 18.87 | −0.433 | 6.51 | Stable |
| B7 | 32.26 | −0.39 | 6.52 | Stable |
| B8 | 100 | −0.422 | 6.54 | Stable |
| B9 | 200 | −0.253 | 6.54 | Stable |
| Xu 31264.5 | Single binder | −45.1 | 6.09 | Unstable |

Example 2

Exemplary coating compositions were prepared according to the formulations shown in TABLE 2. Amounts are parts by weight based on 100 parts of the total inorganic pigments. The inorganic pigments used were Hydrocarb HG® and Covergloss®.

TABLE 2

| Formulation ID | Hydrocarb HG ® | Covergloss ® | Calcium Chloride | Leucophor NS LIQ ® | Foamaster VF ® | Binder mixture |
|---|---|---|---|---|---|---|
| F10 | 80 | 20 | 12 | 5 | 0.2 | B9 (11 parts) |
| F11 | 80 | 20 | 12 | 5 | 0.2 | B7 (11 parts) |
| F12 | 80 | 20 | 12 | 5 | 0.2 | B6 (11 parts) |
| F13 | 80 | 20 | 12 | 5 | 0.2 | B5 (11 parts) |
| Comparative 1 | 80 | 20 | 12 | 5 | 0.2 | Panford 280 (17 parts) |
| Comparative 2 | 80 | 20 | 0 | 5 | 0.2 | XU31264.5 (12 parts) |

Covergloss ® is kaolin clay, available from J.M. Huber Corporation.
Hydrocarb HG ® is a calcium carbonate slurry, available from Omya Corporation.
Leucophor NS LIQ ® is an optical brightening agent (OBA) available from Clariant Corporation.
Foamaster VF ® is a petroleum derivative defoamer, available from Cognis Corporation.

The coating compositions in TABLE 2 were prepared in the laboratory using a 55 gal jacked processing vessel made of stainless steel (from A&B Processing System Corp., Stratford, Wis.). A Lighthin mixer (from Lighthin Ltd, Rochester N.Y.) with gear ratio 5:1 and a speed of 1500 rpm was used to mix the compositions. The appropriate amount of water was first charged into the vessel followed by adding the inorganic pigments. The binder mixtures B9, B7, B6, B5 made in Example 1 were added to formulations F10-F13, respectively. Comparative 1 formulation contains only Panford 280 as a single binder. Comparative 2 formulation contains only XU 31264.5 as a single binder. Powder of calcium chloride (technical grade) was pre-dissolved into a 30% by weight solution in a metal container and then mixed into the vessel in an amount specified by each formulation. After adding calcium chloride, Foamaster VF and Leucophor NS LIQ were added to each formulation.

Each of the coating compositions prepared in Example 2 was applied on both sides of a base paper to form a coating layer on each side. The coating process was accomplished either in small quantities by hand drawdown using a Mayer rod in a plate coating station, or in a large quantity by a pilot coater equipped with a blade as the metering device.

The base paper was made on a papermaking machine using a fiber furnish consisting of 80% by weight mechanical wood pulp, 15% by weight precipitated calcium carbonate as a filler, and 5% wet end additives. The basis weight of the base paper was about 52 gsm. The average pore size of the base paper, as measured by mercury extrusion tester, was about 1.2 micrometer and the base paper has a HST value of 28 seconds.

The coat weight of the coating layer was about 12 gsm each side. The coated paper was dried then calendared at 60° C. under a pressure of from 1000 to 3000 pound per square inch (psi) using a laboratory soft-calendar. The brightness, whiteness and opacity of the coated paper samples were recorded and shown in TABLE 3. CIE whiteness was determined using Colortouch from Technidyne Company per ISO method 11475 at D65/10°.

TABLE 3

| Paper Sample ID | Brightness (TAPPI) | Whiteness (CIE) | Opacity |
|---|---|---|---|
| F10-F13 | 85 | 93.0 | 91.2 |
| Comparative 1 | 77 | 81.0 | 89.2 |
| Comparative 2 | 89 | 96.0 | 91.0 |

All of the coated paper samples were printed in an inkjet high-speed inkjet press from Hewlett-Packard Co. and the printing test results are shown in TABLE 4.

TABLE 4

| Sample ID | KOD | Color gamut | B line raggedness | Color-color line raggedness |
|---|---|---|---|---|
| F10-F13 | 1.41 | 180,000 | 11.6 | 20.6 |
| Comparative 1 | 1.4 | 179,500 | 10.5 | 18.9 |
| Comparative 2 | 0.95 | 99,433 | 19.88 | 24.97 |

Black optical density (KOD) and color gamut were measured using and X-Rite densitometer. The higher KOD value indicates a darker printing effect. The higher value of color gamut indicates that the printed images show richer or more saturated colors. B line raggedness refers to the average of the leading edge and trailing edge raggedness, and measures the appearance of geometric distortion of an edge from its ideal position. Color-color line raggedness refers to inter-color edge sharpness due to the invasion of one color ink. into the other. Smaller values indicate better edge quality.

The results shown in TABLES 3 and 4 indicate that Samples F10-F13 (the improved media of the present disclosure) have higher brightness, whiteness and opacity as compared to Comparative 1 paper (whose coating formulation contains only one binder). Even though Comparative 2 paper (whose coating formulation contains only one binder and does not contain metallic salt) has brightness, whiteness and opacity that are comparable to Samples F10-F13, printed image printed on Comparative 2 paper showed significantly lower KOD and color gamut, and higher line raggedness as compared to printed images printed on Samples F10-F13.

Samples F10-F13 yields improvement in print quality in terms of KOD and color gamut as to both compared to Comparative 1 paper and Comparative 2 paper.

Comparison of Porosity

The porosity of some commercially available coated papers was measured and compared to that of the coated paper samples F10 and F11 produced according to Example 2.

TABLE 5

| Coated Paper Samples | Porosity (Sheffield Unit) | Ink Dry Time |
|---|---|---|
| F10 | 17.7 | Good |
| F11 | 22.0 | Good |
| Xerox coated laserjet paper | 0.0 | Bad |
| Staples 180 (coated inkjet paper) | 12.2 | Bad → average |
| 34 BowGloss (coated offset paper) | 0.8 | Bad |
| 40 BowGloss (coated offset paper) | 0.0 | Bad |
| 50 BowGloss (coated offset paper) | 0.0 | Bad |
| 28 BowEcoGloss (coated offset paper) | 5.2 | Bad |
| 32 BowEcoGloss (coated offset paper) | 12.2 | Bad |

As indicated in Table 5, the Staples 180 paper, the Xerox laserjet paper and the commercially available offset papers have porosity values that are either 0 or lower than those of F10 and F11. Consequently, the drying time of these commercially available papers is not as good as that of samples F10 and F11. In addition, both Xerox laserjet paper and Staples 180 are based on chemical pulp and are more expensive to make as compared to samples F10 and F11.

The improved coated paper described in this disclosure has been found to exhibit high brightness and whiteness and good resistance to yellowing when exposed to lights. When this paper is used as the receiving media in high-speed inkjet web press, fast dry time, low degree of ink bleed and edge roughness are some of the improvements found. The improved coated paper of the present disclosure is particularly suitable as the receiving medium for printing magazine, catalogs, inserts, flyers, direct mail, books and other commercial printing products using high speed, inkjet web press printing.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of 1 part to 20 parts should be interpreted to include not only the explicitly recited concentration limits of about 1 part to about 20 parts, but also to include individual concentrations such as 2 parts, 3 parts, 4 parts, etc.

Although the present disclosure describes certain representative embodiments and examples, it will be understood to those skilled in the art that various modifications may be made to these representative embodiments and examples without departing from the scope of the appended claims.

What is claimed is:

1. A print medium for high speed, digital inkjet printing comprising:

a base paper formed from a fiber furnish containing at least 30% by weight of mechanical pulp; and a coating layer formed on at least one surface of the base paper, said coating layer comprising: a metallic salt; a first binder, a second binder; and at least one inorganic pigment, wherein the first binder is a water-soluble binder selected from the group consisting of casein, soy protein, polysaccharides, cellulose ethers, alginates, virgin and modified starches, polyvinyl alcohol and polyvinyl pyrrolidone, the second binder is selected from the group consisting of polymeric latexes with $T_g$ not greater than 50° C., the ratio of the first binder to the second binder, in dry weight, is 6:1 to 200:1, said at least one inorganic pigment is selected from the group consisting of ground calcium carbonate (GCC), and precipitated calcium carbonate (PCC), and wherein said print medium has a porosity value ranging from 15 to 40 Sheffield units.

2. The print medium of claim 1, wherein the coating layer further comprises a second inorganic pigment selected from the group consisting of compounds with aluminum silicate structure, and is present in an amount not greater than 30 parts based on 100 parts of inorganic pigments in total.

3. The print medium of claim 1, wherein said second inorganic pigment is kaolin clay.

4. The print medium of claim 1, wherein the second binder is selected from the group consisting of latex polymers with $T_g$ in the range of −20° C. to 20° C.

5. The print medium of claim 1, wherein the metallic salt is selected from water-soluble, mono- or multi-valent metallic salts, which have cation selected from Group I metals, Group II metals, Group III metals, or transition metals, and anion selected from chloride, iodide, bromide, nitrate, sulfate, sulfite, phosphate, chlorate, acetate ions, or combinations thereof.

6. The print medium of claim 1, wherein the base paper has an average pore size in the range of 0.01 μm to 5.0 μm as measured by a Mercury size extrusion tester.

7. The print medium of claim 1, wherein the coating layer has a coat weight ranging from 1 to 20 gsm and the base paper has a basis weight ranging from 30 to 170 gsm.

8. The print medium of claim 1, wherein the ratio of the metallic salt to the second binder, by weight, is from 15:2 to 75:2.

9. The print medium of claim 1, wherein base paper is formed from a fiber furnish containing at least 80% by weight of mechanical pulp.

10. A method of making a print medium for high speed, digital inkjet printing, said method comprising:

(a) mixing water and at least one inorganic pigment in a mixing tank;

(b) pre-mixing a first binder and a second binder, and adjusting the ratio of the binders to ensure that the Zeta potential of the binder mixture is in the range of ±5 mV;

(c) adding the binder mixture into the mixing tank and mixing the components therein to form a dispersion;

(d) adding a metallic salt into the mixing tank and mixing to form a coating solution;

(e) applying the coating solution onto at least one side of a base paper to form a coating layer thereon; and (f) drying the coated base paper, wherein said base paper is formed from a fiber furnish containing at least 30% by weight of mechanical pulp, wherein said first binder is a water-soluble binder selected from the group consisting of casein, soy protein, polysaccharides, cellulose ethers, alginates, virgin and modified starches, polyvinyl alcohol and polyvinyl pyrrolidone, said second binder is selected from the group consisting of polymeric latexes with $T_g$ not greater than 50° C., and the ratio of the first binder to the second binder, in dry weight, is 6:1 to 200:1, and wherein said at least one inorganic pigment is selected from the group consisting of ground calcium carbonate (GCC), and precipitated calcium carbonate (PCC).

11. The method of claim 10, wherein the print medium formed by said method has a porosity value ranging from 15 to 40 Sheffield units.

12. The method of claim 10 further comprising calendaring the coated base paper after drying.

13. The method of claim 10 further comprising adding a second inorganic pigment in step (a) in an amount not greater than 30 parts based on 100 parts of inorganic pigments in total, said second inorganic pigment is selected from the group consisting of compounds with aluminum silicate structure.

14. The method of claim 10, wherein the metallic salt is selected from water-soluble, mono- or multi-valent metallic salts, which have cation selected from Group I metals, Group II metals, Group III metals, or transition metals, and anion selected from chloride, iodide, bromide, nitrate, sulfate, sulfite, phosphate, chlorate, acetate ions, or combinations thereof.

15. The method of claim 10, wherein the base paper is formed from a fiber furnish containing at least 80% by weight of mechanical pulp.

* * * * *